United States Patent [19]

Hermann

[11] Patent Number: 4,947,747

[45] Date of Patent: Aug. 14, 1990

[54] HAND-HELD LABELING DEVICE WITH PIVOTALLY MOUNTED FRONT PLATE

[76] Inventor: Klaus-Dieter Hermann, Ritterweg 17, D-6932 Hirschhorn, Fed. Rep. of Germany

[21] Appl. No.: 396,290

[22] Filed: Aug. 21, 1989

Related U.S. Application Data

[63] Continuation of Ser. No. 181,301, Apr. 13, 1988, abandoned.

[30] Foreign Application Priority Data

Apr. 16, 1988 [DE] Fed. Rep. of Germany ..... 3712963

[51] Int. Cl.[5] ..... B41F 1/02; B41K 5/02

[52] U.S. Cl. ..... 101/288; 101/320

[58] Field of Search ..... 101/288, 291, 292, 330, 101/329, 320; 156/384

[56] References Cited

U.S. PATENT DOCUMENTS

| | | | |
|---|---|---|---|
| 4,044,677 | 8/1977 | Hamisch, Jr. | 101/320 |
| 4,075,949 | 2/1978 | Conley | 101/288 |
| 4,116,747 | 9/1978 | Hamisch, Jr. | 101/288 |
| 4,194,448 | 3/1980 | Becker et al. | 101/288 |
| 4,213,389 | 7/1980 | Sato | 101/288 |
| 4,252,060 | 2/1981 | Strausburg | 101/329 |
| 4,273,046 | 6/1981 | Sato | 101/320 |
| 4,276,828 | 7/1981 | Sato | 101/288 |
| 4,290,840 | 9/1981 | Pabodie et al. | 101/288 |
| 4,419,171 | 12/1983 | Becker et al. | 101/288 |
| 4,699,685 | 10/1987 | Sato | 101/288 |
| 4,793,889 | 12/1988 | Becker | 101/288 X |

*Primary Examiner*—Clifford D. Crowder
*Attorney, Agent, or Firm*—Walter A. Hackler

[57] ABSTRACT

A hand-held labeling device includes a two-line tape-printing mechanism, which can be actuated by means of a movable handle and which can be transferred by a swinging movement of the handle from a rest position to a printing position where characters of the printing mechanism hit against labels arranged above a printing plate so as to print such characters on the labels. A rocking lever fixed to the housing and pivoting about an axis arranged in the front portion of the housing and carrying an inking attachment which during, is guided to ensure that at least one ink roller slides tangentially across the characters before the latter hit upon the labels. Adjoining side walls of the housing, and projecting into the interior of the housing, are fixed in a front plate of the housing of the device. The rocking lever is seated in the said extensions at a distance from the front plate, for pivotal movement about an axis fixed to the housing, and said printing mechanism is accommodated, at least in the rest position, between parts of the said rocking lever arranged adjacent the said fixed axis. The front plate is pivotally mounted to the housing for enclosing the printing mechanism.

15 Claims, 9 Drawing Sheets

HAND-HELD LABELING DEVICE WITH PIVOTALLY MOUNTED FRONT PLATE

This application is a continuation of application Ser. No. 181,301, filed Apr. 13, 1988, now abandoned.

The present invention relates to a hand-held labeling device comprising a printing mechanism, in particular an at least two-line tape-printing mechanism, which can be actuated by means of a movable handle and which can be transferred by a swinging movement of the handle from a rest position to a printing position where characters of the printing mechanism hit against labels arranged above a printing plate so as to print such characters on the labels, and comprising further a rocking lever fixed to the housing, pivoting about an axis arranged in the front portion of the housing and carrying an inking attachment with at least one ink roller which during movement of the printing mechanism is guided to ensure that the ink rollers slide tangentially across the characters before the latter hit upon the labels.

In the case of the hand-held device of this type known from DE-OS 26 38 441, the inking attachment comprising an ink roller is mounted on a rocking lever which is seated for pivotal movement about a lug of the fold-out front plate of the device. This design is, however, connected with the disadvantage that after the inking attachment has applied ink on the characters of the printing mechanism, part of the inking attachment projects from the front end of the housing of the device, immediately above the pressure roll, i.e. in immediate proximity to the object to be labeled. This is awkward, in particular when many objects have to be labeled in rapid succession. In the case of this known device, the ink roller is directly mounted on the rocking lever so that when changing the inking attachment the user, being required to manipulate the ink roller directly, will soil his hands with the ink which is very difficult to remove. Due to the fact that the rocking lever is mounted directly on the front plate, it is hardly possible with this inking attachment to ink more than two rows of characters as the kinematics of the rocking movement of the rocking lever make it impossible for the ink roller to ink additional rows of characters, for example a third or a fourth row, arranged further back in the inking attachment.

DE-OS 30 08 165 discloses a device with a rocking lever where the inking attachment comprises an inking roller and a supply roller for the ink, the two rollers being supported in a special roller holder seated to pivot about an axis at the end of the rocking lever. This roller holder does not, in the position in which the printing mechanism is in contact with the label, project from the forward portion of the housing of the device, but pivots about the before-mentioned axis from the vertical position required for the inking process into a vertical position in which it comes to rest against the front face of the printing mechanism and can be accommodated, due to this vertical position, in the space between the printing mechanism and the front wall of the housing. The roller holder is exchangeable. But the arrangement of the rocking lever is again such that the roller holder cannot reach far to the back at the bottom of the printing mechanism because in the rest position of the parts its circular path provoked by the rocking lever does not extend flat relative to the bottom face of the printing mechanism, but projects therefrom at a relatively large angle.

Now, it is the object of the present invention to improve a hand-held labeling device of the type described above in such a manner that in the case of very big printing mechanisms, for example multi-line type-printing mechanisms, even the rear rows of characters are safely inked, while it is still possible to arrive at a space-saving construction where no parts project out of the housing of the labeling device during the operating cycle.

This object is achieved according to the invention by an arrangement which is characterized in that extensions 21 adjoining the side walls 25 of the housing and projecting into the interior of the housing are fixed on a front plate 22 of the housing of the device, that the rocking lever 19 is seated in the extensions 21 at a distance from the front plate, for pivotal movement about an axis 20 fixed to the housing, and that the printing mechanism 16 is accommodated, at least in the rest position, between parts of the rocking lever 19 arranged adjacent the fixed axis 20.

The invention provides the advantage that the path of movement of the inking attachment, which extends in the form of a circular segment about the pivotal axis of the rocking lever, exhibits a horizontal tangent below the axis and, farther to the rear, towards the handle of the device, a tangent extending only at a relatively small angle relative to the bottom face of the printing mechanism. It is therefore easily possible to construct the device in such a manner that the inking attachment can move a large way underneath the printing mechanism, in the direction of the fixed handle of the labeling device, and ink several rows of characters.

In addition, it is easily possible with this position of the pivot axis of the rocking lever to realize a design which, according to one embodiment of the invention, enables the roller holder of the inking attachment to be pivoted by approximately 90°, upon completion of the inking process, so that the inking attachment can be accommodated in the space between the forward edge of the printing mechanism and the front wall of the housing, without any parts projecting from the latter, when the printing mechanism is applied upon the label. According to one embodiment of the invention the roller carrier is, therefore, seated on the rocking lever to pivot about another pivot axis extending in parallel to the pivot axis of the rocking lever which is fixed to the housing. This provides the additional advantage that thanks to this pivotal connection between the roller carrier and the rocking lever an additional degree of freedom of movement of the elements of the hand-held labeling device is provided which enables an optimized path of movement to be provided for the printing mechanism also in the area beneath the printing mechanism. This pivotal connection between the printing mechanism and the rocking lever also permits the provision of a relatively large inking attachment comprising several ink rollers because this additional pivot axis enables the inking attachment to be pivoted into an advantageous space-saving, for example a vertical, position once it has left the bottom face of the printing mechanism. A large inking attachment comprising several ink rollers in the roller holder offers the additional advantage that the design can be selected in such a manner that the rows of characters can be brought into contact with several ink rollers during the inking process so that perfect inking of the rows of characters will be guaranteed even if the inking power of a single roller should no longer be sufficient for perfect inking.

The additional pivoting movement of the roller carrier may be utilized in certain embodiments of the invention for providing a bore-and-pivot joint at this point, which joint may in addition be designed in the form of a detachable snap-in connection so that the roller carrier can be easily removed or inserted for the purpose of exchanging the inking attachment so that such change of the roller carrier can be carried out without any problems even by unskilled operators.

The larger the distance between the fixed pivot axis of the rocking lever and the front plate of the device, i.e. the more this axis is spaced inwardly from the periphery of the printing mechanism, the greater is the rearward reach of the printing mechanism along the bottom face of the printing mechanism and the greater is the number of rows of characters that can be inked by the inking attachment. Nevertheless, one can still find an arrangement where the inking attachment is erected to a vertical position after it has left the bottom face of the printing mechanism so that it can be accommodated in a space-saving manner in the forward portion of the housing, without any parts projecting from the front of the device during the operating cycle. According to one embodiment of the invention, the printing mechanism, therefore, is not only engaged between portions of the rocking lever adjacent the fixed pivot axis of the latter, and portions of the extensions on which the rocking levers are pivoted, but enters in its rest position into the space between the parts on which the rocking lever is pivoted far enough to ensure that even the fixed pivot axis of the path of movement of the printing mechanism is located inside the latter's periphery.

EP-A 16/5 172 describes an arrangement where the inking attachment is arranged in the middle of the device, between the printing mechanism and the fixed handle of the hand-held labeling device. However, this arrangement requires an absolutely different design of the hand-held labeling device and is, in addition, connected with the disadvantage that the inking attachment, which constitutes a consumable part of the printing mechanism, is not easily accessible, at least not as easily as in the case of the embodiments of the invention where access can be obtained simply by folding out the front plate of the device.

This feature, which is rendered possible by the fact that cheeks of the rocking lever are pivoted on their outsides, opens up a range of additional constructional possibilities for achieving extremely compact paths of movement inside the hand-held labeling device because now the different pivoting elements can move inside each other—viewed from the side—without obstructing one another.

According to another preferred embodiment of the invention, the pivoting means include a pivot joint and a pivot-and-slot guide.

This feature provides the advantage that the rocking lever is not only rotated about its pivot axis, but is in addition guided during its pivotal movement.

In addition, the two pivot connections are easily to produce so that the device according to the invention can easily be assembled and, if necessary, disassembled for servicing purposes.

According to another preferred embodiment of the invention, the spacing between the pivot axis and the front plate is substantially equal to the height of the roller carrier.

This feature simplifies a design where the rocking lever and the inking attachment enter fully the space between the front of the printing mechanism and the front plate in the printing position of the printing mechanism, without any parts projecting beyond the outer contour of the housing of the hand-held labeling device. The arrangement of the inking attachment behind the front plate of the hand-held labeling device, which is known as such, provides the advantage that the inking attachment can be exchanged very easily in this readily accessible position.

According to another embodiment of the invention, the roller carrier preferably carries at least two ink rollers provided with radial wheels, and the wheels run along the surface of the printing mechanism during movement thereof.

This feature provides the advantage that the ink rollers of the inking attachment can be guided on countersurfaces on the printing mechanism in a reproducible manner, i.e. by means of relatively hard wheels. Compared with known guiding arrangements where the soft ink rollers themselves run along the character side of the printing mechanism, this solution provides the advantage that the guiding arrangement uses hard and abrasion-resistant elements (wheels/surfaces); in addition, the ink rollers are touched in this case only, when they get into contact with the rows of characters, and no additional contacts which would lead to unnecessary ink losses are required for guiding purposes.

According to a variant of this embodiment of the invention, the wheels define the lateral ends of the ink rollers and run on lateral shoulders of the printing mechanism.

This feature provides the advantage that being guided on both sides the inking attachment is guaranteed to run smoothly, without any risk of tilting.

According to another variant of this embodiment of the invention, the wheels run substantially in horizontal direction on lateral shoulders of a bottom face of the printing mechanism in a first motion phase of the printing mechanism, and substantially vertically on lateral shoulders of a front face of the printing mechanism in a second motion phase.

This feature provides the considerable advantage that the character side of the printing mechanism, which due to the relatively large radius of the circular path of movement of the printing mechanism runs almost constantly in the horizontal sense, can be inked optimally during the first motion phase because several ink rollers run across all printing lines, while on the other hand, in the second motion phase, the inking attachment can retract upwardly into the space between the printing mechanism and the front plate where it occupies the least possible space.

In this connection, an arrangement is particularly preferred where a lower front corner of the printing mechanism engages an indentation provided in side walls of the roller carrier at the point of transition from the first to the second motion phases.

This feature provides the advantage that the inking attachment changes its direction along its path of movement in a controlled and defined manner.

According to other embodiments of the invention, the roller carrier is seated by means of lateral pivots engaged in bores in the cheeks, and in order to provide greater play between the cheeks an inclined surface leads from at least one bore to one limiting edge of the cheeks.

This feature provides the considerable advantage that the roller carrier can be snapped into the rocking lever with one flick of the wrist, and can also be easily removed because it is only necessary to position the lateral pivots on the inclined surfaces and push the roller carrier in from the side, as the cheeks are caused by this action to spread apart elastically to enable the pivots to slide into the bores.

According to still another preferred embodiment of the invention, the roller carrier and the rocking lever are provided with stops for limiting the pivotal movement of the roller carrier relative to the rocking lever.

This feature provides the advantage that a defined position of the inking attachment is obtained in both final positions of the path of movement due to the attachment getting into contact with the stops.

A particularly preferred embodiment of the invention is characterized in that the roller carrier is provided with a handle portion and with first form-locking means coacting with second form-locking means of the rocking lever in such a way that the roller carrier can be inserted into the rocking lever by means of the handle piece only in a single defined position.

This feature provides the advantage that the roller carrier can be inserted into the rocking lever with one flick of the wrist and only in the correct position so that it is impossible, even for unskilled operators, to mount the roller carrier in an incorrect position, for example with the inking attachment oriented the wrong way, whereby the printing mechanism would be rendered unserviceable.

According to another preferred embodiment of the invention, the rocking lever is pivoted on extensions of a front plate located at the end of the hand-held labeling device opposite the movable handle, which extensions extend approximately parallel to side walls of the hand-held labeling device.

This feature provides the advantage that by forming the extensions integrally with the front plate, the assembly of the device is rendered particularly easy because no special means are required for implementing the pivot joint of the rocking lever.

In this connection, an arrangement is particularly preferred where the front plate, with the rocking lever mounted thereon, can be folded out to the front and away from the hand-held labeling device.

This feature provides the essential advantage that the front plate, with the rocking lever and the inking attachment mounted thereon, can be exposed by folding out the front plate so that the inking attachment can be removed and/or inserted without any problems, even by an unskilled operator.

It is particularly preferred in this case if the front plate can be pivoted about an axis at the bottom of the hand-held labeling device, because then this axis may serve simultaneously as rotary axis for a feed roll of the hand-held labeling device.

According to other variants of this embodiment of the invention, the front plate is provided with a window, and can be folded away from the hand-held labeling device by disengaging elastic snap-in means through such window.

This feature provides the advantage that the window constitutes a handle element which does not project from the device and does not impair the handling ease of the handheld labeling device. It must be considered in this connection that during operation, in particular when the device is used for labeling goods in series, at high speeds, the user will guide the device along a curved path so that there is always the risk that any elements projecting from the housing may get into contact with other objects and break off or get damaged.

According to another preferred variant of this embodiment of the invention, a spring is provided between the front plate and the rocking lever for loading the rocking lever in a direction away from the front plate.

This feature provides the advantage that when the front plate is folded out the rocking lever, with the inking attachment mounted thereon, swings out automatically which provides particularly easy access for exchanging the inking attachment. On the other hand, the spring guarantees the contact pressure necessary for guiding the inking attachment along the printing mechanism in the described manner.

Finally, another embodiment of the invention is preferred where the inner face of the front plate on the one hand and the bottom faces of the rocking lever and the roller carriers on the other hand exhibit matching shapes. This feature provides the advantage that the rocking lever and the inking attachment can adapt themselves optimally to the inside of the front plate in the end position of their path of movement so that they occupy only very little space.

Other advantages of the invention will become apparent from the following specification and the attached drawing.

It is understood that the features that have been described above and which will be explained further below can be used not only in the described combinations, but also in any other combination or individually without leaving the scope of the present invention.

Certain embodiments of the invention will now be described in greater detail with reference to the drawing in which:

FIG. 1*a* shows a side view, partly broken away, of a hand-held labeling device;

FIG. 1*b* shows a side view similar to that of FIG. 1*a*, but viewed from the opposite side;

The following specification refers to all figures, and identical elements are designated by the same reference numeral.

Figure 1A:
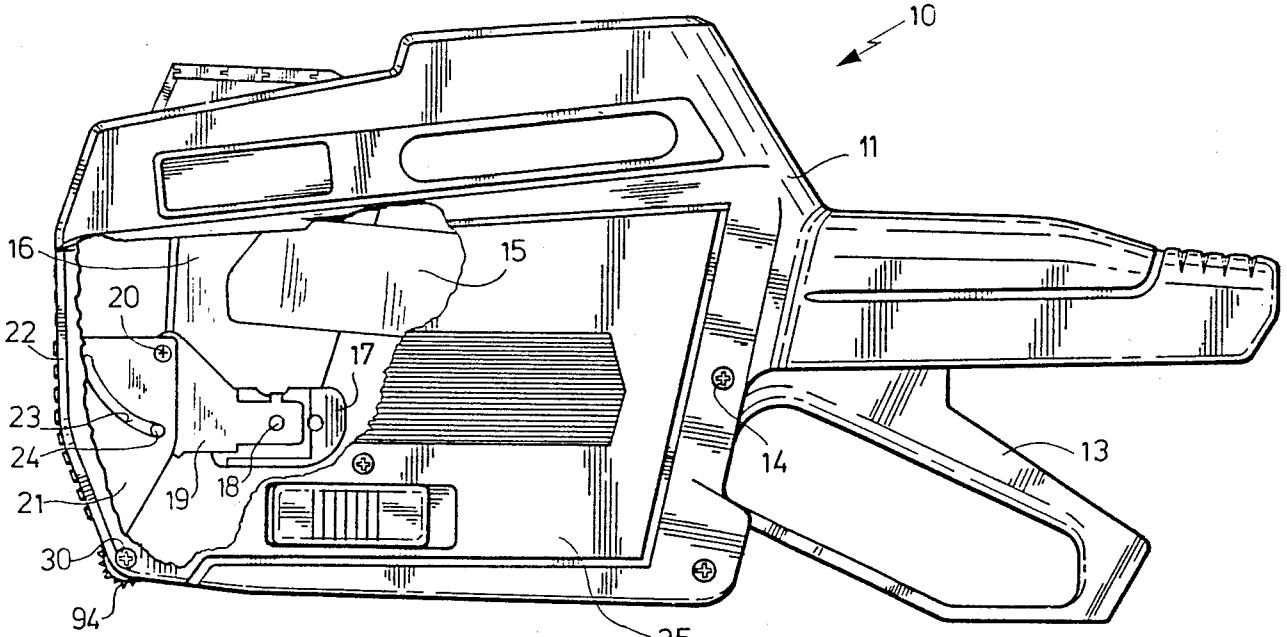
Figure 1B:
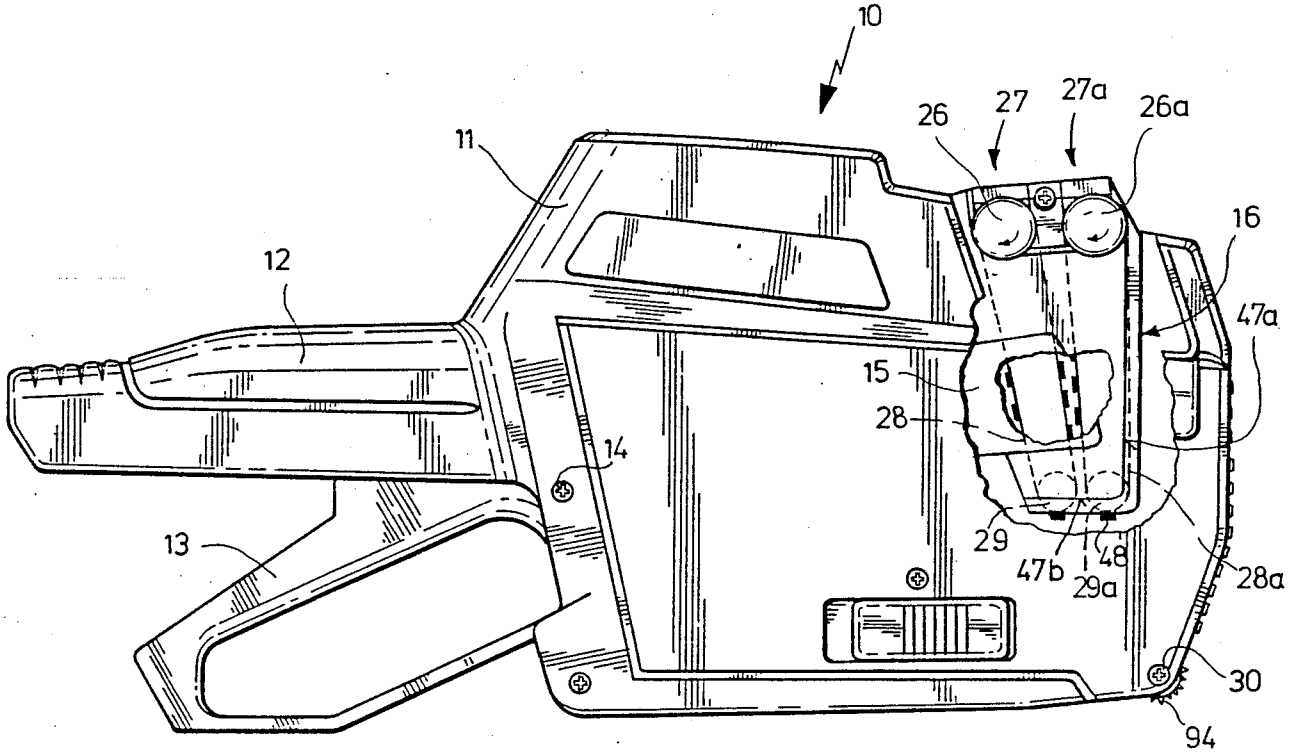

In FIGS. 1*a* and 1*b*, a hand-held labeling device is generally designated by reference numeral 10. The hand-held labeling device 10 comprises a housing 11, usually made from a plastic material, which ends on the rear side in a handle 12 fixed to the housing. On the rear side of the housing 11, a movable handle 13, which is arranged to pivot about a first axis 14, projects from the fixed handle 12. On the other side of the first axis 14, the movable handle 13 continues in the form of two lateral flat arms 15 serving for actuating a printing mechanism 16 located in the front portion of the housing 11. In the rest position of the hand-held labeling device 10, when the movable handle 13 is in its fully extracted position, as illustrated in FIG. 1*a*, the printing mechanism 16 occupies an upper end position in contact with a stop not shown in detail.

Below the printing mechanism 16, one can see an inking attachment 17 which is seated on a rocking lever 19 to pivot about a second horizontal axis 18. The rocking lever 19 in turn is arranged to pivot about a third horizontal axis 20 extending through plate-shaped extensions 21 arranged at a right angle relative to the front plate 22. The extensions 21 comprise in addition a slot 23 guiding a first pivot 24 of the rocking lever 19. The extensions 21 extend substantially in parallel to the side walls 25 of the housing 11.

From FIG. 1*b* it appears that the illustrated embodiment is that of a hand-held labeling device 10 comprising a printing mechanism 16 designed as a two-line band-printing mechanism. The device, therefore, comprises two setting wheels 26, **26*a* arranged one behind the other near the upper face of the hand-held labeling device 10 and below windows 27, 27*a*** provided in the said upper face.

By rotating the setting wheels 26, **26*a*, type bands 28, 28*a* are moved which are guided on the one hand on wheels arranged coaxially with the setting wheels 26, 26*a*** and not shown in FIG. 1*b* and, on the other hand, on wheels 29, **29*a* provided at the bottom of the printing mechanism 16. By rotating the setting wheels 26, 26*a*, a defined printing type can be brought to an appropriate position on the underside of the printing mechanism 16, and the corresponding symbol is indicated through the windows 27, 27*a***.

The setting wheels 26, **26*a*** are movable axially in a direction vertical to the drawing plane of FIG. 1*b* so that the type bands arranged one behind the other in the representation shown in FIG. 1*b* can be moved one by one. According to a typical embodiment of the invention, for example ten such type bands 28, **28*a* carrying each, for example, twenty-eight different characters, may be arranged one behind the other. The printing mechanism 16**, therefore, may have two, three or even more ten-digit type lines on its bottom face.

Figure 2:
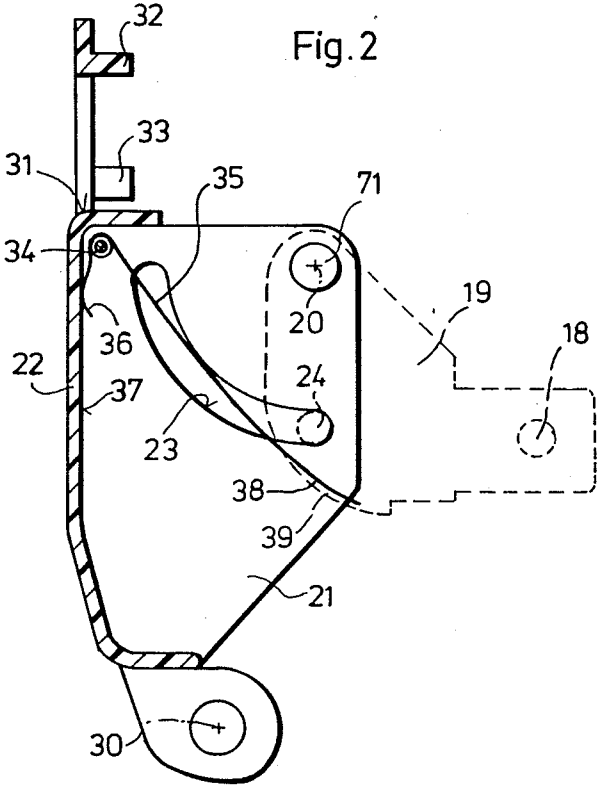
FIG. 2 shows a side view, cut along line II—II in FIG. 3 through a front plate of a hand-held labeling device according to the invention.
Figure 3:
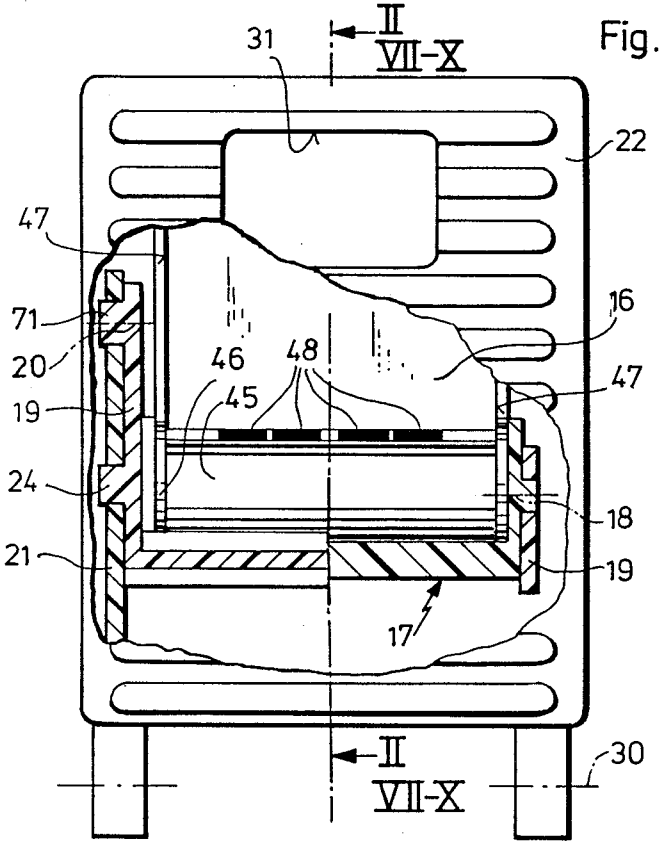
FIG. 3 shows a front view of the front plate according to FIG. 2, partly broken away and cut along two lines IIIa—IIIa (left half) and IIIb-IIIb (right half) in FIG. 7.

In FIGS. 2 and 3 it can be seen that the front plate 22 can be folded away from the housing 11 about a fourth horizontal axis 30. The front plate 22 is provided on its upside with a window 31 large enough to enable a user to reach through this window with a finger in order to pivot the front plate 22 about the fourth axis 30. The front plate 22 is securely held in the housing 11 on the one hand by a guide strip 32 arranged above the upper edge of the window 31, and on the other hand by two lateral locking projections 33 which are provided beside the window 31 at the edges of the front plate 22 and which in the closed position of the front plate 22 engage behind matching form-locking means provided on the housing 11. The degree of elasticity of these locking projections 33 is such that by reaching with a finger into the window 31 one can fold out the front plate 22 against a slight mechanical resistance.

Below the window 31, there is provided a horizontally extending bar 34 with a leg spring 35 wound thereon. A first end 36 of the leg spring 35 is in contact with the inner face 37 of the front plate 22, while a second end 38 engages a groove 39 in the rocking lever 19 which is indicated in FIG. 2 by broken lines. The groove 39 is shown in greater detail also in FIG. 6. In the folded-out condition of the front plate 22, the leg spring 35 causes the rocking lever 19 to move automatically into the position shown in FIG. 2.

From FIG. 3 it appears that the inking attachment 17 comprises at least one, typically two ink rollers 45 delimited laterally by radial wheels 46. The radial wheels 46 exhibit a larger diameter than the ink roller 45. The inking attachment 16 is provided with shoulders **47*a*, 47*b*** on its lower and its front edges, which shoulders can be seen clearly also in FIG. 1*b*. The size of the shoulders **47*a*, 47*b* and the arrangement of the inking attachment 17 relative to the printing mechanism 16, which will be described in greater detail further below, are selected in such a manner that the radial wheels 46 run along the shoulders 47*a*, 47*b***.

It is also clearly visible in FIG. 3 that the pivot joints between the rocking lever 19 and the extensions 21 on the one hand and the inking attachment 17 and the rocking lever 19 on the other hand are constituted each by a pivot-and-bore joint which will be described in greater detail further below.

Figure 4:
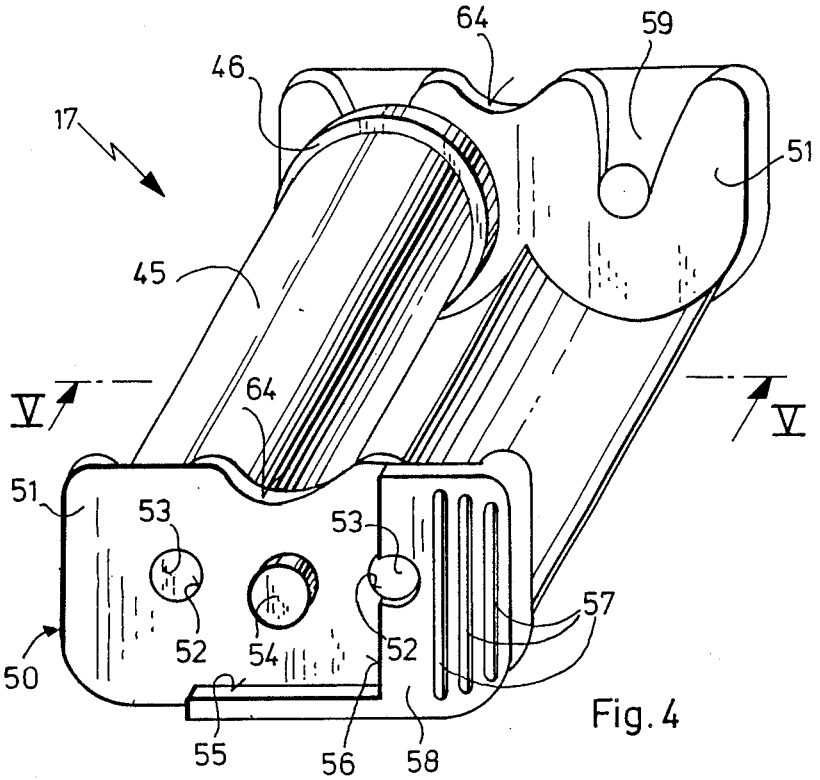
FIG. 4 is a perspective view, in enlarged scale, of an inking attachment of a hand-held labeling device according to the invention.
Figure 5:
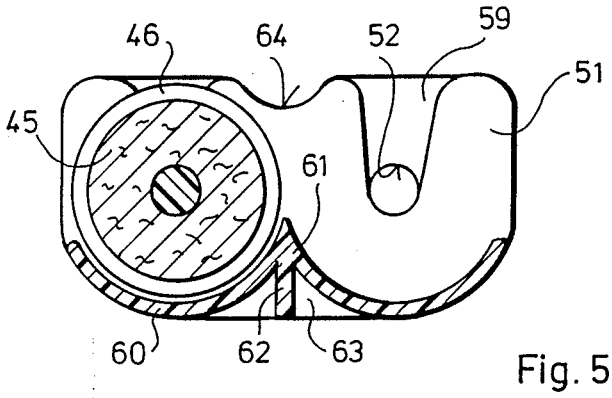
FIG. 5 is a cross-sectional representation of the inking attachment shown in FIG. 4, taken along line V—V in FIG. 4.

FIGS. 4 and 5 show additional details of the inking attachment 17. A substantially U-shaped roller carrier 50—viewed from the side—is provided with side walls 51. Each of the side walls 51 exhibits two spaced-apart bores 52 which are engaged by the second pivots, or pins, 53 of the radial wheels 46. A third pivot 54 arranged on each side wall 51 between the second pivots 53 serves for mounting the roller carrier 50 in the rocking lever 19.

The right half of the side walls 51—as viewed in FIG. 4—carries on the bottom of its outside a horizontally extending strip serving as a lower stop 55 and joining a lateral stop 56 formed by a forwardly projecting thicker portion of the side walls 51 with grip-improving grooves 57 provided thereon.

The side walls 51 are provided on their inner faces, above the bores 52, with first inclined surfaces 59 which provide somewhat greater play at the upper edge of the side walls 51 so that ink rollers 45 with radial disks 46 and second pivots 53 attached thereon can be inserted from above between the two side walls 51, without any mechanical resistance. Now, if the ink rollers 45 are pushed downwardly into the roller carrier 50, the side walls 51 give way a little elastically to the outside until the second pivots 53 engage the bores 52 so that the ink rollers 45 are retained in position safely and in rotary relationship.

A bottom 60 is formed by curved portions extending on either side of its center axis and forming an upwardly directed pointed edge 61 between the ink rollers 45. The space between the curved portions of the bottom 60 is free from built-in parts, except from one longitudinal rib 62 and a plurality of spaced-apart transverse ribs 63. Finally, it can be clearly seen in FIGS. 4 and 5 that the upper edges of the side walls 51 are provided with a curved indentation 64 the purpose of which will be described in greater detail further below, in connection with FIG. 9.

Figure 6:
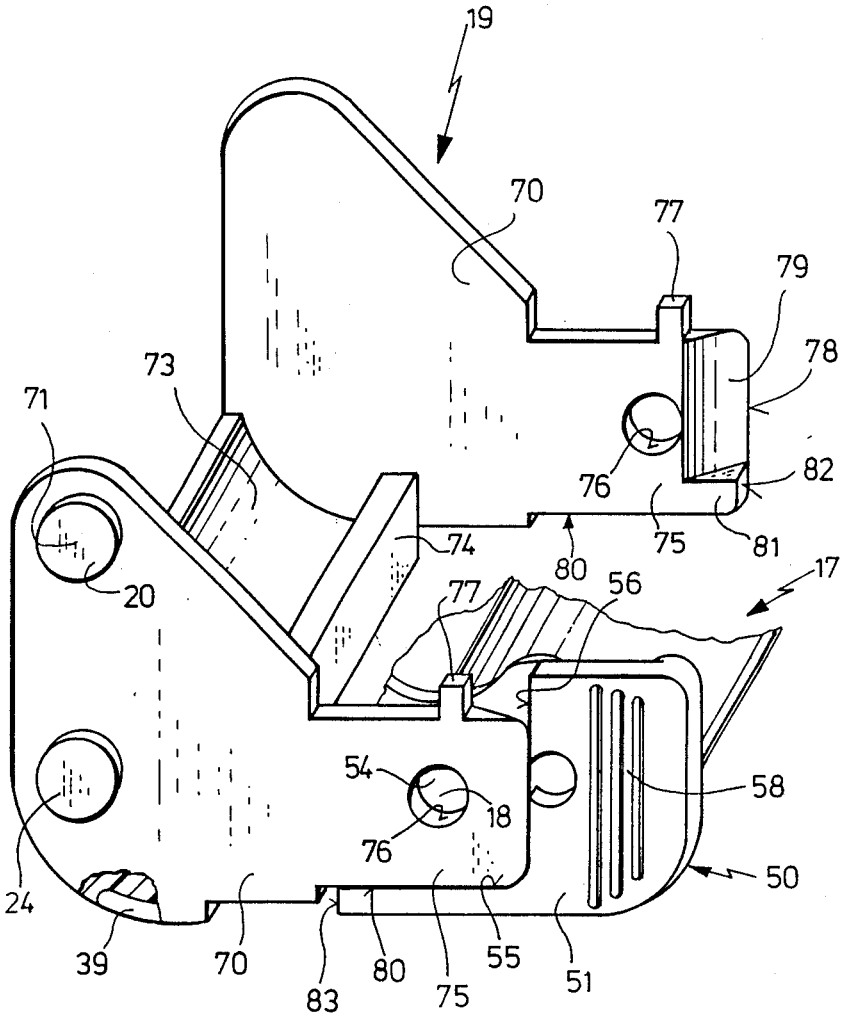
FIG. 6 is a perspective representation, in enlarged scale, of a rocking lever of a hand-held labeling device according to the invention, with inserted inking attachment which is, however, partly broken away.

FIG. 6 shows a perspective view of the rocking lever 19. As can be seen clearly in this drawing, the rocking lever 19 comprises two lateral cheeks 70 carrying on its left edge—as viewed in FIG. 6—an upper fourth pivot 71 and a lower, namely the first pivot 24 which project outwardly from the cheeks 70. The pivots 24, 71 are also visible in FIG. 2 and FIG. 3, left half, and it can be seen that the pivot 71 extends along the third axis 20 and is accommodated in a corresponding bore provided in the extensions 21.

The cheeks 70 are interconnected at their lower left side—as viewed in FIG. 6—by an arc-shaped connection, and the connection 73 ends at the right front in an upwardly projecting web 74. As will be described further below, this connection of the cheeks 70 serves the only purpose in the left lower area to keep the connection elements 73 and 74 out of the path of movement of the printing mechanism when the latter moves during operation.

In the representation of FIG. 6, the cheeks 70 end on their right side in projecting arms 75 provided with bores 76. The bores 76 are engaged by the third pivots 54 of the roller carrier 50 which extend along the second axis 18.

On the upper face of the projecting arms 75, cuboid stops 77 are provided which come to rest against the lateral stops 56 of the side walls 51 when the roller carrier 50 pivots about the second axis 18 in counterclockwise direction. On the other hand, in the rest position shown in FIG. 6, the lower stop 55 is in contact with the lower edge 80 of the projecting arms 75 so that the rotary movement of the roller carrier 50 about the second axis 18 is limited altogether to this angular range of 45°, for example.

The forward edges 78 of the projecting arms 75 are interconnected with the bores 76 by horizontal second inclined surfaces 79. Now, an inking attachment 17 can be introduced between the projecting arms 75 of the rocking lever 19 from the right—as viewed in FIG. 6—by gripping the roller carrier 50 laterally by its handle piece 58. Due to the increased play provided by the second inclined surfaces 79 in the area of the forward edges 78, the third pivots 54 of the roller carrier 50 enter between the second inclined surfaces 79 without any mechanical resistance and the projecting arms 75 give way laterally to the outside until the third pivots 54 snap into the bores 76.

During this insertion of the inking attachment 17 into the rocking lever 19, the lower stop 55, with the lower edge 80, serves simultaneously as a guide so that the third pivots 54 enter the area of the bores 76 at the correct height.

In order to render the inserting movement even safer, the second inclined surface 79 does not extend over the full height of the forward edge 78, but ends a short way before the lower edge so that there remains a lower end 81 extending over the full width of the projecting arms 75 so that a small end face 82 is left at the lower ends of the forward edges 78 whose lower edge may serve as a guide for the forward end 83 of the strip of the side wall 51 of the roller carrier 50 serving as lower stop 55.

FIGS. 7 to 10 illustrate certain motion phases of the printing mechanism 16 and the inking attachment 17 of the hand-held labeling device 10 according to the invention.

Figure 7:
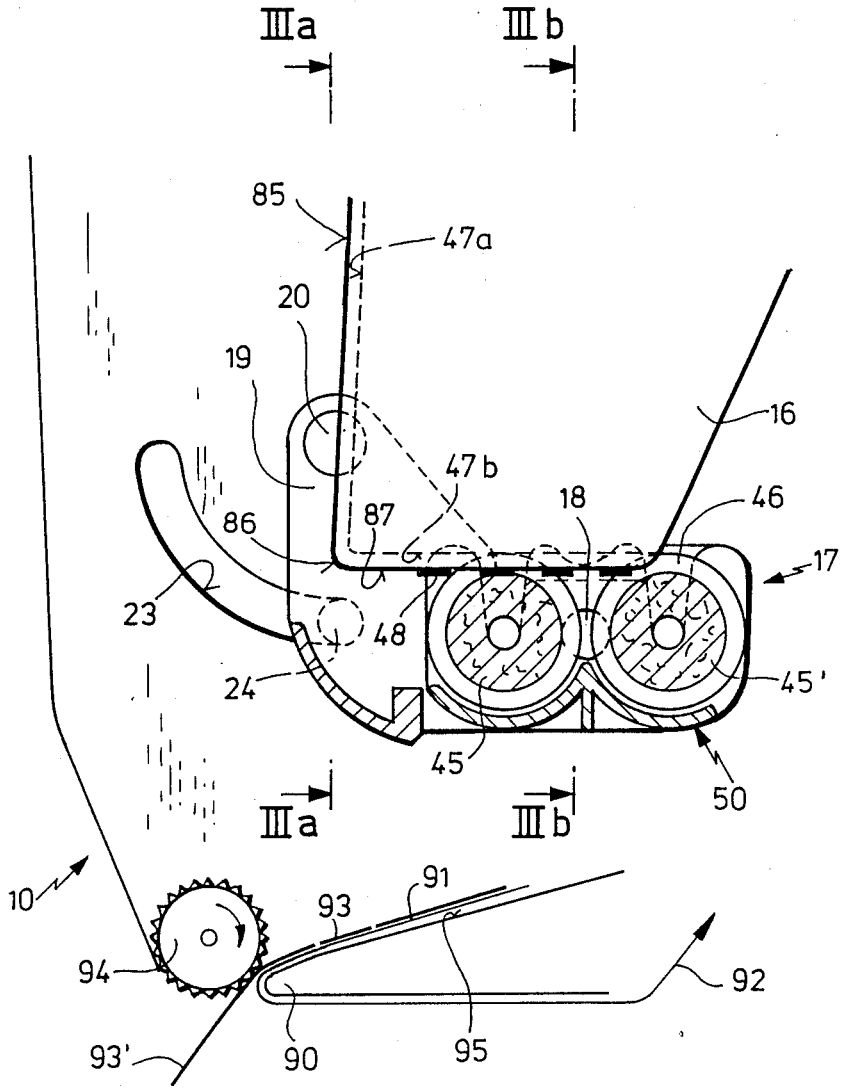
FIG. 7 shows a partial cross-sectional representation, taken along line VII—VII in FIG. 3, of the forward portion of a hand-held labeling device according to the invention, for illustrating a first motion phase, namely an initial position of a motion cycle.
Figure 8:
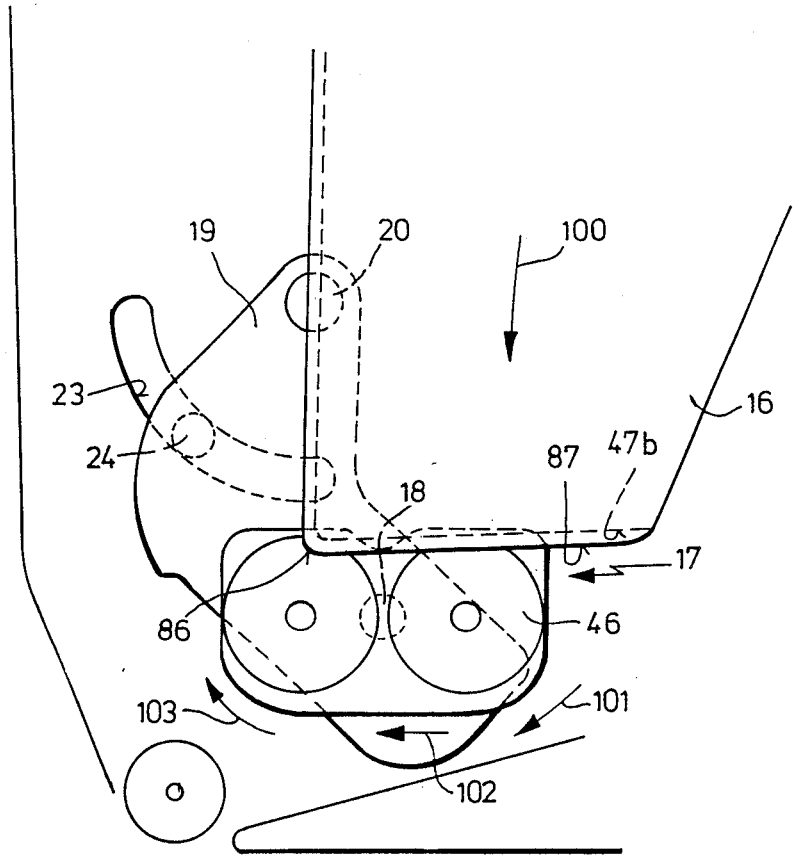
FIGS. 8 to 10 show three additional, more schematized representations of certain motion phases of the hand-held labeling device.

FIG. 7 shows the initial position in which the movable handle 13 is in its fully open position and urged against a stop—not shown in the drawing—by the force of a spring which is likewise not shown. The printing mechanism 16 is in its upper end position in which its forward edge 85 is in an almost vertical position. A lower forward corner 86 forms the transition to a lower edge 87 of the printing mechanism 16. In this initial position, the third axis 20 is approximately aligned with the forward edge 85, and the lower edge 87 is located a little above the first pivot 24 which occupies its lower end position at one end of the quadrant-shaped slot 23.

The inking attachment 17 is provided with two ink rollers 45, 45′ arranged one beside the other, the right ink roller 45′ being located outside the four lines of printing types 48 shown by way of example, while the left ink roller 45 may be located in the area of the second print line.

FIG. 7 illustrates also certain other details of the handheld labeling device 10, namely a pointed guiding edge 90 located below the elements described above. A carrier tape 91 is guided about the guiding edge 90 and leads to feeding means, for example a feed roller, not shown in the drawing, in a direction indicated diagrammatically by arrow 92. The carrier tape 91 carries labels 93, 93′. The last-mentioned label 93′ has already largely come off the carrier tape 91 and may be stuck upon an object not shown in the drawing by means of a pressure roll 94.

Before the guiding edge 90—viewed in the feeding sense of the carrier tape 91, one can see a slightly rising pressure plate 95 the inclination of which is selected in such a way that its production line preferably intersects the first axis 14 if the production line of the lower edge 87 of the printing mechanism 16 also intersects that first axis 14.

When the movable handle 13 is now retracted so far that the first pivot 24 performs approximately half its travel through the slot 23 (FIG. 8) the printing mechanism 16 will pivot downwarly about the first axis 14 in the direction indicated by arrow 100. This pivotal movement causes the rocking lever 19 to pivot about the third axis 20 in the direction indicated by arrow 101. The inking attachment 17 runs almost linearly to the left, in the direction indicated by arrow 102, but performs during this travel a slight rotary movement in clockwise direction about the second axis 18, in the direction indicated by arrow 103. During this motion phase, the inking attachment 17 is guided by the radial wheels 46 running along the shoulder 47*b* of the lower edge 87 of the printing mechanism 16.

Figure 9:
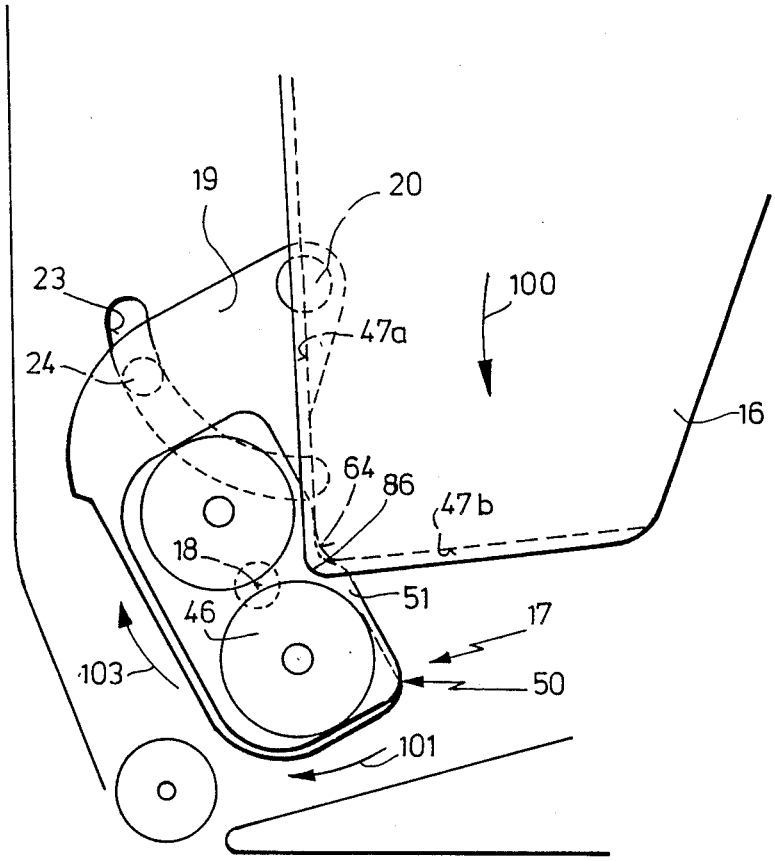

FIG. 9 shows another motion phase, where the printing mechanism has moved further down, in the direction indicated by arrow 19. While the position of the rocking lever 19 has changed only little by a slight rotation about the third axis 20 in the direction indicated by arrow 102 so that the first pivot 24 has now passed approximately two thirds of its travel along the slot 23, the inking attachment 17 has changed its position considerably, by pivoting by approximately 45° about the second axis 18, in the direction indicated by arrow 103. This is due to the fact that the printing mechanism 16 engages the indentation 64 in the side wall 51 of the roller carrier 50 by its lower forward corner 86, at the transition between the lower shoulder 47*b* and the forward shoulder 47*a*, whereby the guide previously formed by two contact points between the radial wheels 46 and the lower shoulder 47*b* has been lifted, so that the inking attachment 17 can proceed about the lower forward edge 46 from an almost horizontal path of movement (compare arrow 102 in FIG. 8) to an almost vertical path of movement (compare 104 in FIG. 10).

Figure 10:
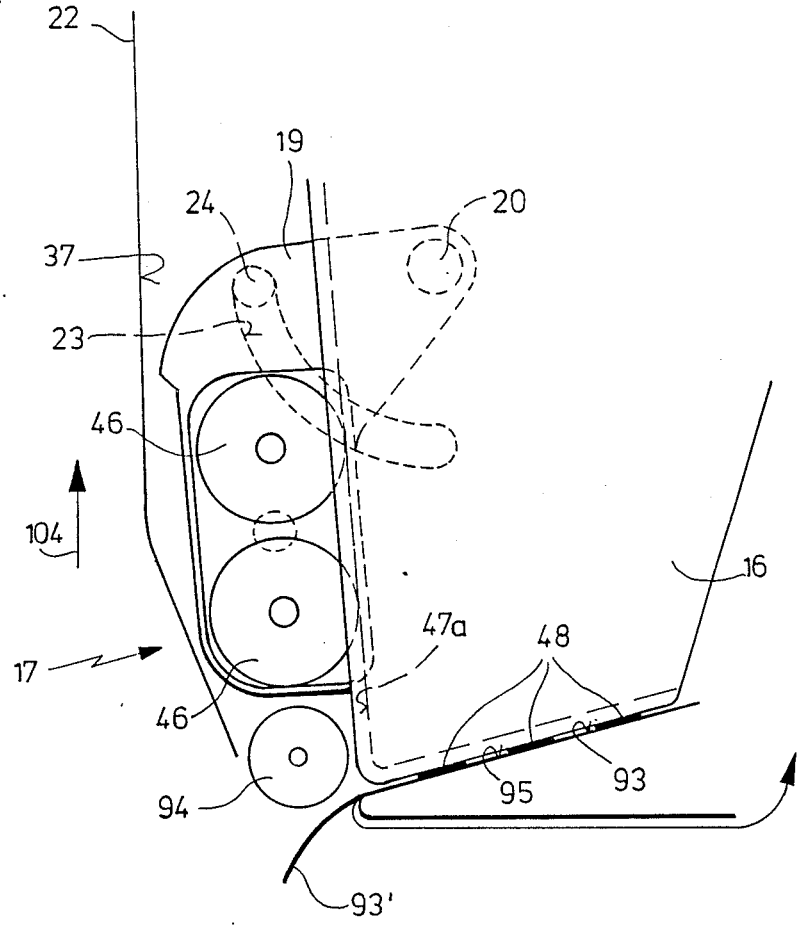

FIG. 10 shows the final state in which the types 48, or the type lines, of the printing mechanism 16 hit upon the label 93, above the printing plate 95. The inking attachment 17 occupies a substantially vertical position in which the radial wheels 46 have moved a little further upwards in the direction indicated by arrow 102, by applying themselves against the forward shoulder 47*a* of the printing mechanism 16, clearing behind them the way for the printing mechanism 16 to its lower final position. The rocking lever 19 also occupies its final position, as demonstrated by the first pivot 24 which has reached the upper end of the slot 23. The lower surfaces of the printing mechanism 17 and of the rocking lever 19 are designed in such a manner that they adapt themselves optimally to the contour of the inner surface 37 of the front plate 22. This makes it possible to accommodate the inking attachment 17, together with all the elements required for its movement, in the space between the front edge of the printing mechanism 16 and the front plate 22, without any components projecting from the housing of the hand-held labeling device 10.

Due to the fact that the rocking lever 19 is designed as an U-shaped part and that the axis 20 is constituted only by pivots 71 engaging corresponding bores, the forward part of the printing mechanism 16 can enter the space between the cheeks 70 of the rocking lever 19 already in its rest position (FIG. 7) so that the roller carrier 50 can project a long way to the right—as viewed in FIG. 7—and below four or even more character lines for inking the latter. In the printing position (FIG. 10) the forward part of the printing mechanism enters the space between the cheeks 70 of the rocking lever 10 even further. By spreading apart the cheeks 70 in the area of the bores 76, the pivots 74 can be disengaged, and the inking attachment 17, together with the ink rollers 45, can be exchanged for example when the ink supply available has been used up. The plate-like extensions 21 projecting inwardly from the front plate 22, substantially at a right angle, are sufficiently elastic to enable their inner edges to be spread apart, in the area of the axis 20, so that the bolt 24 and the pivot 71 can be disengaged from the slot 23 and the bore of the axis 20, respectively, and the rocking lever 19 can be detached from the extensions 21. This action is further assisted by the elasticity of the cheeks 70. Consequently, the assembly of the unit, both during production and in connection with servicing operations, is very simple and can be carried out without the use of any tools, and without the support of a workshop.

I claim:

1. A hand-held labeling device comprising:

a housing;

a printing mechanism including at least one type band extending between a setting wheel disposed at a top of said printing mechanism and a wheel disposed at a bottom of said printing mechanism;

means mounting said printing mechanism within said housing for enabling movement therein from a position at which said type band engages an inking attachment to a position at which the type band imprints a label carried within said housing;

front plate means, pivotally mounted to said housing, for enclosing said printing mechanism within the housing and, when pivoted, enabling access to said printing mechanism;

inking means, disposed within said housing and including at least one ink roller, for inking said type band; and means mounting said inking means behind said front plate for enabling movement of said ink roller from a first position at which the ink roller engages said type band to a second position enabling said printing mechanism to imprint the label, said movement occurring between said printing mechanism and said front plate, said means mounting said inking means comprising a rocking lever pivotally mounted to said housing, and a front plate extension having pivot-and-slot guide means, engaging said rocking lever, for enabling a portion of said rocking lever to be disposed within said printing mechanism when the inking means is disposed in the second position, said pivot-and-slot means being configured for enabling said rocking lever portion to be disposed between the printing mechanism setting wheel and the printing mechanism wheel when the inking means is disposed in the second position.

2. The hand-held labeling device according to claim 1 wherein said roller comprises radial wheel means for guiding said rollers along a surface of the printing mechanism.

3. The hand-held labeling device according to claim 2, wherein said radial wheel means comprises two radial wheels disposed on lateral ends of each ink roller and said printing mechanism surface comprises lateral shoulders.

4. The hand-held labeling device according to claim 3 wherein said means mounting said inking means further comprises means pivotally attaching said rocking arm to said housing for enabling, with said pivot-and-slot means, the radial wheels to run in a substantially horizontal direction along lateral shoulders disposed on said printing mechanism bottom during a first motion phase of the printing mechanism and in a substantially vertical direction along lateral shoulders of a front face of the printing mechanism in a second motion phase of the printing mechanism.

5. The hand-held labeling device according to claim 4 wherein said means mounting said inking means comprises two rocking levers with a roller carrier disposed therebetween.

6. The hand-held labeling device according to claim 5 wherein said printing mechanism comprises lower fron corner means for engaging an indentation in walls of said roller carrier at the point of transition from the first to the second motion phases of printing mechanism.

7. The hand-held labeling device according to claim 6 further comprising means for pivotally mounting said roller carrier between bores in cheeks of said rocking levers and means defining an inclined surface in said cheeks from the bore therein to a limiting edge thereof for providing flexibility between the cheeks.

8. The hand-held labeling device according to claim 7 wherein said roller carrier and rocking levers include means for limiting the pivotal movement of the roller carrier relative to the rocking lever.

9. The hand-held labeling device according to claim 8 wherein said roller carrier comprises a handle portion and first form-locking means for connecting with second rocking lever form-locking means for enabling the roller carrier to be inserted into the rocking lever by means of the handle portion in a single defined position.

10. The hand-held labeling device according to claim 9 wherein said front plate is pivotally mounted to said housing at an underside thereof.

11. The hand-held labeling device according to claim 10 further comprises elastic snap-in means for engaging said front plate with said housing and means defining a window in said front plate for enabling disengagement of said snap-in means.

12. The hand-held labeling device according to claim 11 further comprising spring means disposed between said front plate and a rocking lever bottom face for loading said rocking plate in a direction away from the front plate.

13. The hand-held labeling device according to claim 12 wherein the front plate has an inner face having a shape matching the shape of bottom faces of the rocking levers.

14. The hand-held labeling device according to claim 13 further comprising means, defined by material of construction and thickness, for enabling the rocking device and front face extensions to be spread apart elastically in an axial direction.

15. The hand-held labeling device according to claim 14 wherein the first position of the ink roller is between the bottom of said printing mechanism and a lower portion of the housing and the second position of the ink roller is between a front end of the printing mechanism and the front plate.

* * * * *